US006149558A

United States Patent [19]

Chen

[11] Patent Number: 6,149,558

[45] Date of Patent: Nov. 21, 2000

[54] ADJUSTABLE DUMBBELL

[76] Inventor: James Chen, No. 35, Tun Hi Rd., Chin Chan Li, Sa Lu Taichung, Taiwan

[21] Appl. No.: 09/386,453

[22] Filed: Aug. 31, 1999

[51] Int. Cl.[7] ..... A63B 21/075

[52] U.S. Cl. ..... 482/107; 482/108

[58] Field of Search ..... 482/106–108; D21/680–682

[56] References Cited

U.S. PATENT DOCUMENTS

| | | | |
|---|---|---|---|
| 5,839,997 | 11/1998 | Roth et al. | 482/107 |
| 5,971,899 | 10/1999 | Towley | 482/108 |
| 6,033,350 | 3/2000 | Krull | 482/108 |

*Primary Examiner*—John Mulcahy

*Attorney, Agent, or Firm*—Browdy and Neimark

[57] ABSTRACT

A dumbbell is adjustable in weight and essentially composed of a carrying seat, a plurality of weighted blocks, and a selection device. The carrying seat has two parallel plates and a plurality of rods fastened between the two parallel plates. The plates are provided at the top of the outer side thereof with two hooked portions. The weighted blocks have a main body which is provided with two connection portions. The connection portions of the weighted blocks are located at various levels to enable the weighted blocks to be held together side by side such that the hooked portions of the plates are engaged with the connection portions of the weighted blocks contiguous to the two plates. The selection device is mounted on the carrying seat for enabling selectively a predetermined number of the weighted blocks to be coupled with the carrying seat.

8 Claims, 4 Drawing Sheets

ADJUSTABLE DUMBBELL

FIELD OF THE INVENTION

The present invention relates generally to an exercise device, and more particularly to an adjustable dumbbell.

BACKGROUND OF THE INVENTION

The conventional dumbbell is integrally made of a metal material by casting. The weight of the conventional dumbbell is fixed. As a result, it is necessary to purchase a number of dumbbells of various weights.

The conventional adjustable dumbbell comprises a grip bar and a plurality of weights which are fastened with both ends of the grip bar. The dumbbell can be adjusted in weight by adjusting the number of the weights that are fastened with both ends of the grip bar. However, the conventional adjustable dumbbell is defective in design in that the weights are of a disklike shape, and that the dumbbell is prone to move about on the surface to inflict a wound on one's toes.

With a view to overcoming the drawbacks of the conventional adjustable dumbbell described above, a Taiwanese Patent discloses an adjustable dumbbell comprising a main body having a support plate which is provided in two sides thereof with a slot into which a fastening pin is inserted. By changing the position of the fastening pin, the weight of the dumbbell can be adjusted. The weights are rectangular so that they are not prone to roll on the surface. However, the fastening pin is susceptible to deformation, thereby making the weights vulnerable to becoming unfastened with the connection rod of the weights. The weights are likely to fall on the ground at the time when the dumbbell is in use.

SUMMARY OF THE INVENTION

The primary objective of the present invention is to provide an adjustable dumbbell free from the drawbacks of the prior art dumbbells described above.

In keeping with the principle of the present invention, the foregoing objective of the present invention is attained by an adjustable dumbbell comprising a carrying seat, a plurality of weighted blocks, and a selection device. The carrying seat has two parallel plates and a plurality of rods located between the two plates. The two plates are provided with a through hole which is in turn provided in the inner edge of the outer end thereof with at least one restraint surface. The two plates are provided at the top end of the outer side thereof with two hooked portions. The weighted blocks have a rectangular main body which is provided with a through hole corresponding in location to the through holes of the plates and is further provided with two connection portions. The connection portions of the weighted blocks are various in height so as to enable the weighted blocks to be joined together by the connection portions which are engaged with the hooked portions of the two plates. The selection device comprises a grip rod which is rotatably disposed in the through holes of the two plates and is provided at both ends thereof with a threaded hole of a depth and extending along the longitudinal direction of the grip rod. These two threaded holes are opposite to each other in rotational direction and are provided with a pin which is engaged at one end thereof with the threaded hole and is received at other end thereof in the through hole of the plate. The pins are provided with a pressing surface which comes in contact with the restraint surface. As the grip rod is turned, the pins are capable of extracting from or retracting into the grip rod, so as to extend into the through holes of the weighted blocks, thereby resulting in the coupling of the carrying seat with a desired number of the weighted blocks.

The features and the advantages of the present invention will be more readily understood upon a thoughtful deliberation of the following detailed description of the embodiments of the present invention with reference to the accompanying drawings.

DETAILED DESCRIPTION OF THE INVENTION

Figure 1:
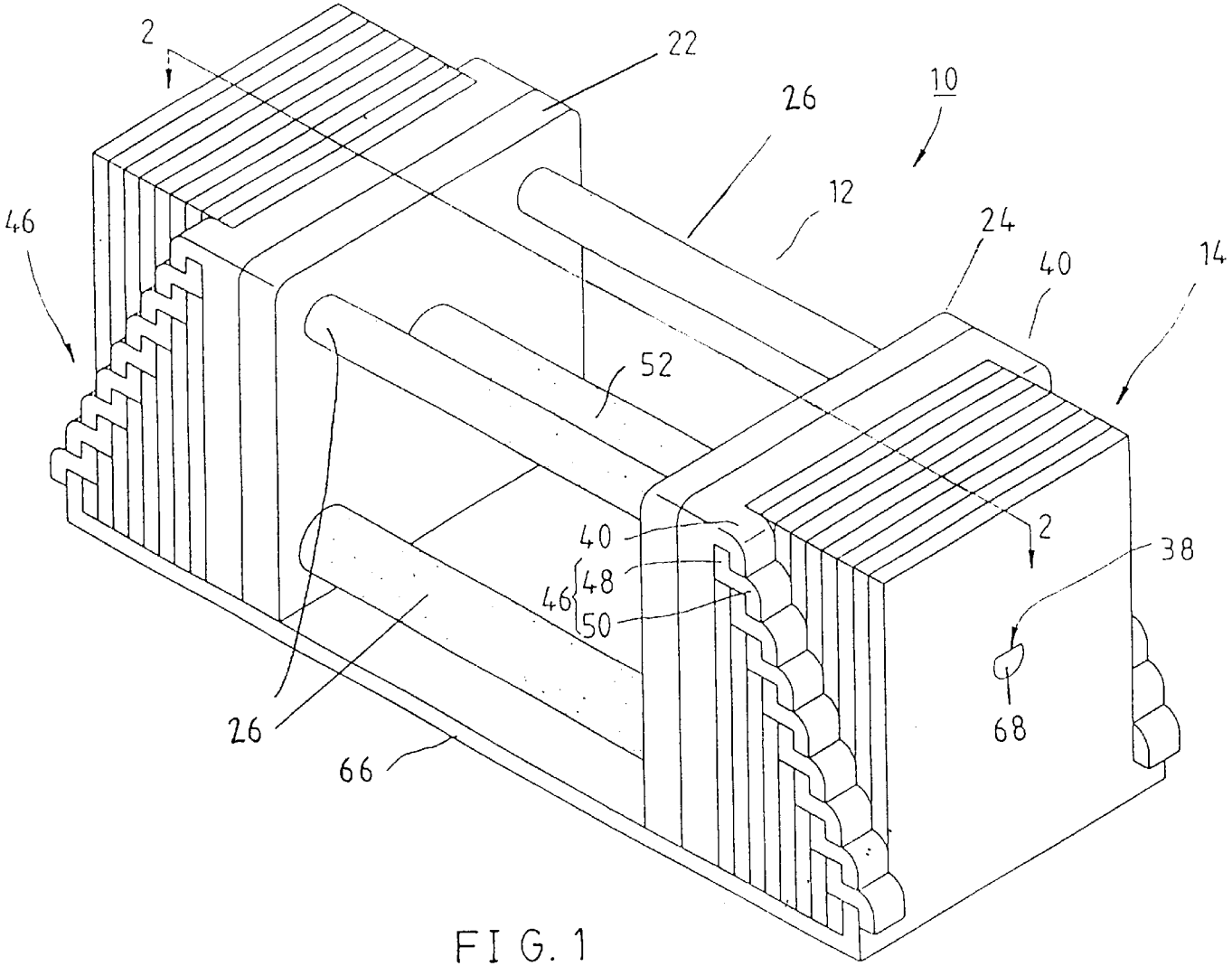
FIG. 1 shows a perspective view of a first preferred embodiment of the present invention.
Figure 2:
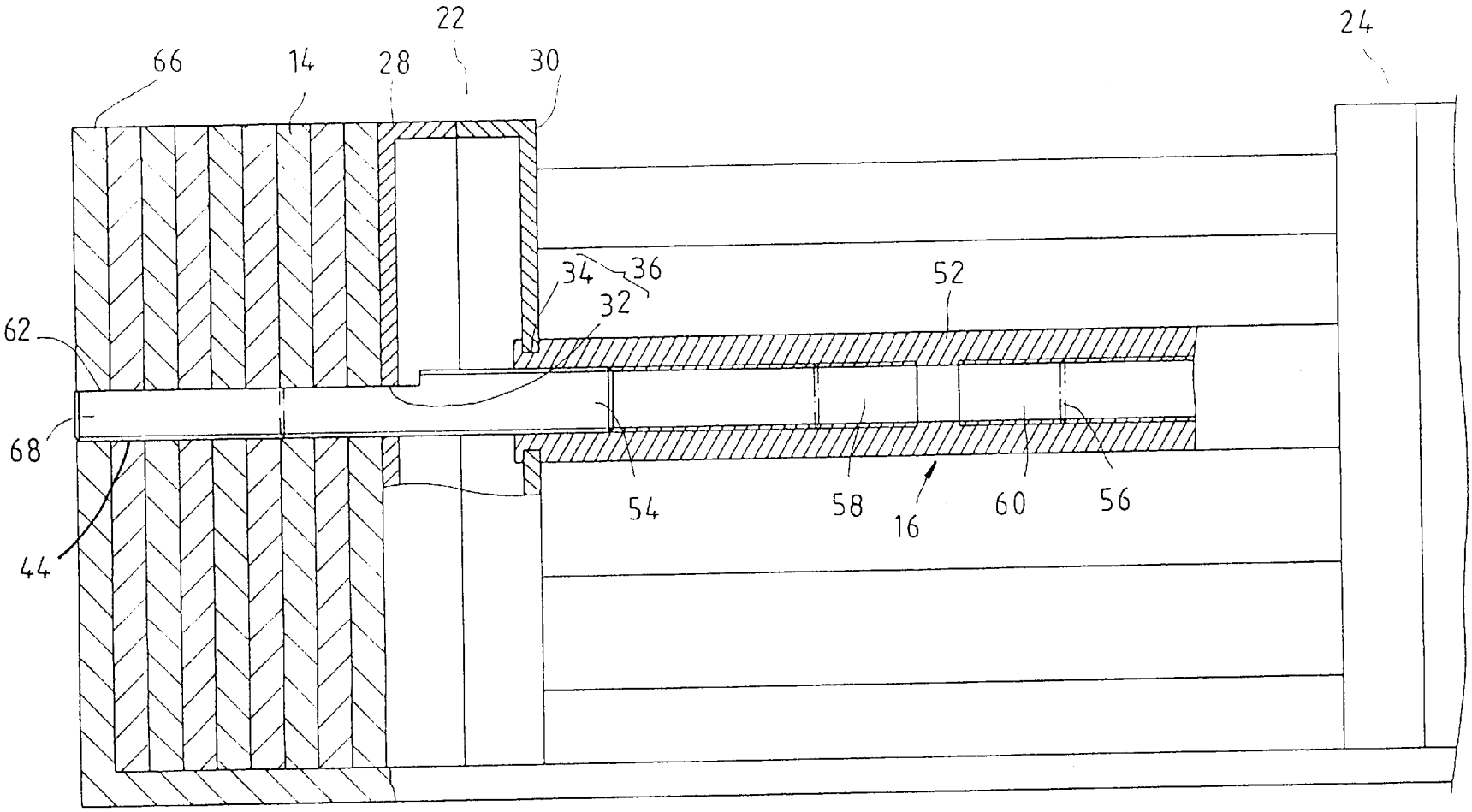
FIG. 2 shows a sectional view of a portion taken along the direction indicated by a line 2—2 as shown in FIG. 1.

As shown in FIGS. 1 and 2, an adjustable dumbbell 10 embodies in the present invention comprises a carrying seat 12, sixteen weighted blocks 14, and a selection device 16.

The carrying seat 12 has two rectangular plates 22, 24, four rods 26 fastened with four comers of the two plates 22 and 24. The two plates 22 and 24 are formed of two half shell bodies 28 and 30, each of which are provided in the center thereof with two through holes 32 and 34. These two through holes 32 and 34 are different in inner diameter from each other for forming a through hole 36. The through hole 32 is semicircular and is provided in the top edge thereof with a restraint surface 38. The two plates 22 and 24 are provided in the top end of the outer side thereof with two hooked portions 40 which are integrally formed therewith.

Each of the weighted blocks 14 is made of a metal material by punching and has a rectangular main body 42 which is provided with a through hole 44 and two connection portions 46, with each connection portion 46 having a receiving block 48 and a retaining block 50 formed at the bottom of the receiving block 48. The connection portions 46 of the weighted blocks 14 are located at different levels. The sixteen weighted blocks 14 are divided into two groups, which are located on the outside of the plates 22 and 24. The weighted blocks 14, which are in a direct contact with the plates 22 and 24, are retained by two hooked portions 40 engaging the receiving blocks 48. The weighted blocks 14 are joined together side by side such that the retaining block 50 of one weighted block 14 is engaged with the receiving block 48 of another weighted block 14 contiguous to the one weighted block 14.

The selection device 16 comprises a grip rod 52 and two pins 54 and 56. The grip rod 52 is of a hollow tubular construction and is rotatably mounted between the through holes 34 of the two plates 22 and 24. The grip rod 52 is provided at two ends of the inner side thereof with two threaded holes 58 and 60, which are opposite in rotation direction to each other. The two pins 54 and 56 have a semicircular cross section corresponding to through hole 44 and are provided in the outer periphery thereof with threads. The pins 54 and 56 are engaged at one end thereof with the threaded holes 58 and 60 such that other end thereof is received in the through hole 32, and that each press surface 62 at the ends of pins 54 and 56 respectively press against the restraint surfaces 38 of the two through holes 32.

The dumbbell 10 further comprises a placing block 66 which has a U-shaped cross section and is made of a metal plate by curving. The placing block 66 serves to facilitate the arranging of the weighted blocks 14 in both ends of the inner side of the placing block 66 before placing the carrying seat 12 between the weighted blocks 14. Both ends of the placing block 66 are provided with a through hole 68 opposite in location to the through hole 44 of the weighted block 14 and corresponding in cross-section to that of through hole 44.

In using the dumbbell 10, the carrying seat 12 and the weighted blocks 14 coupled with the carrying seat 12 are raised with a hand holding the grip rod 52, thereby resulting in the building effect of muscles of the arm.

The weight of the dumbbell 10 of the present invention can be adjusted by the user of the dumbbell 10 by turning the grip rod 52 to cause the two pins 54 and 56 to extend into the through holes 44 of the weighted blocks 14. The pins 54 and 56 can not be turned because they are confined by the through holes 32. As a result, a desired number of the weighted blocks 14 are coupled with the carrying seat 12 by the pins 54 and 56. The number of the weighted blocks 14 which are coupled with the carrying seat 12 can be reduced by turning the grip rod 52 in reverse so as to cause the pins 54 and 56 to move back into the grip rod 52. As a result, there are fewer weighted blocks 14 that are coupled with the carrying seat 12 by the pins 54 and 56.

The weighted blocks 14 are held together side by side such that the retaining blocks 50 and the receiving blocks 48 are engaged. The weighted blocks 14 are held to the outside of the two plates 22 and 24 by the hooked portions 40. The weighted blocks 14 are selected and then coupled with the carrying seat 12 by the pins 54 and 56. The weighted blocks 14, which are not loaded, are still held together by means of the retaining blocks 50 and the receiving blocks 48 which are engaged with the retaining blocks 50. For this reason, these weighted blocks 14 can be easily loaded on the dumbbell 10 by the selection device 16.

Figure 3:
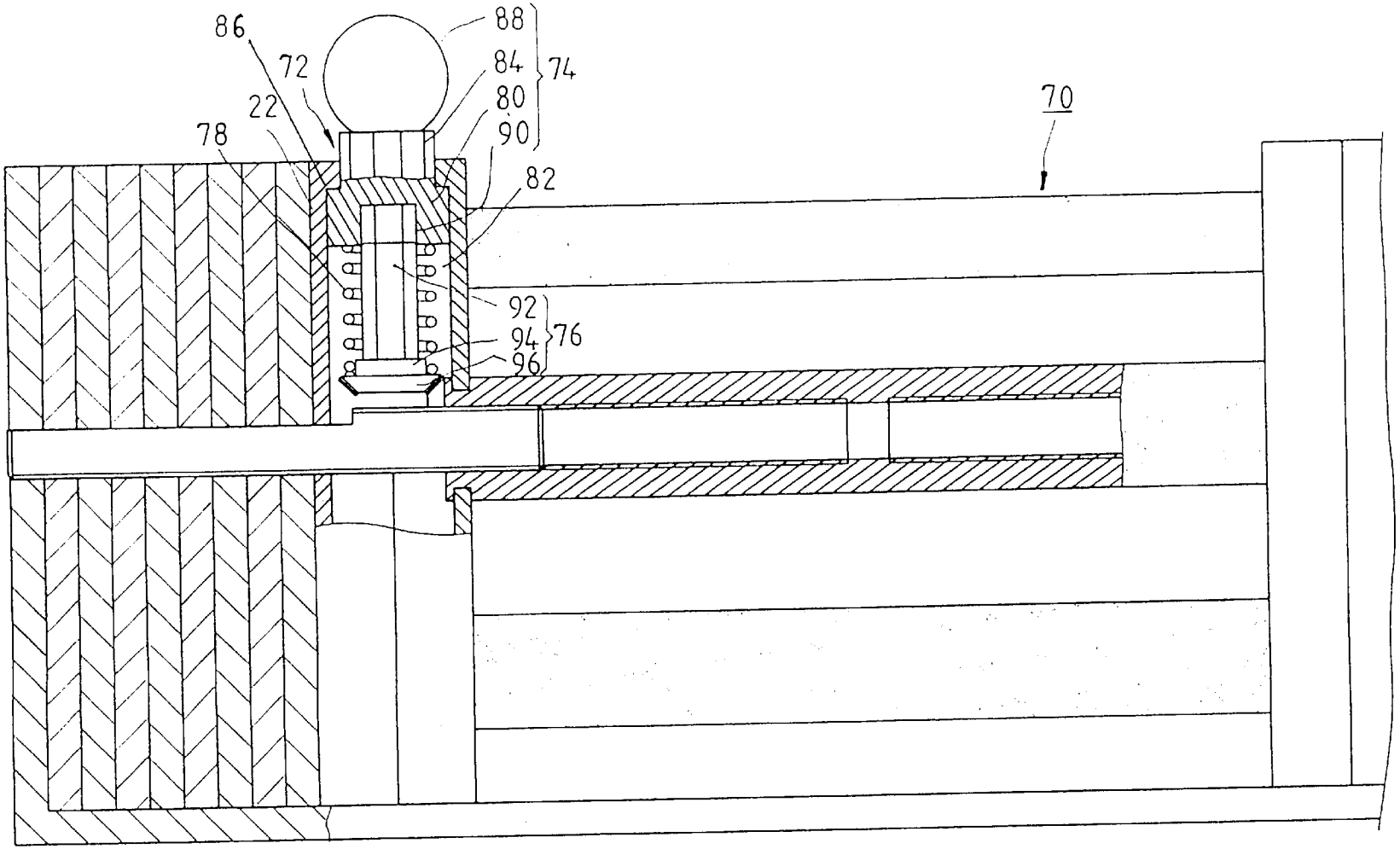
FIG. 3 shows a sectional view of the coupling of the adjustment device with the grip rod of a second preferred embodiment of the present invention.

As shown in FIG. 3, a dumbbell 70 of the second preferred embodiment of the present invention is basically similar in construction to the dumbbell 10 described above, with the difference being that the selection device 16 of the dumbbell 70 comprises an adjustment device 72 which is formed of a drive member 74, a link member 76, and an elastic member 78. The drive member 74 has a retaining block 80 which is movably disposed in a receiving space 82 that is formed in the inner side of the plate 22. The top end 84 of the retaining block 80 is complementarily fitted into an octagonal opening 86 of the plate 22 and is provided with a spherical drive end 88. The retaining block 80 is further provided at the bottom thereof with a connection portion 90, which is a recess having a hexagonal cross section. The link member 76 has a main body 92 which is hexagonal in its cross section, an apron 94 located at the bottom of the main body 92, and a sector gear 96 which is located at the bottom of the apron 94 and is engaged with one end of the grip rod 52. The elastic member 78 is a spiral spring and is located between the bottom of the retaining block 80 and the sector gear 96 for enabling the retaining block 80 to locate at the top of the receiving space 82 at such time when the retaining block 80 is not exerted on by an external force. The spring 78 also enables the top end of the main body 92 to extend slightly into the connection portion 90.

Figure 4:
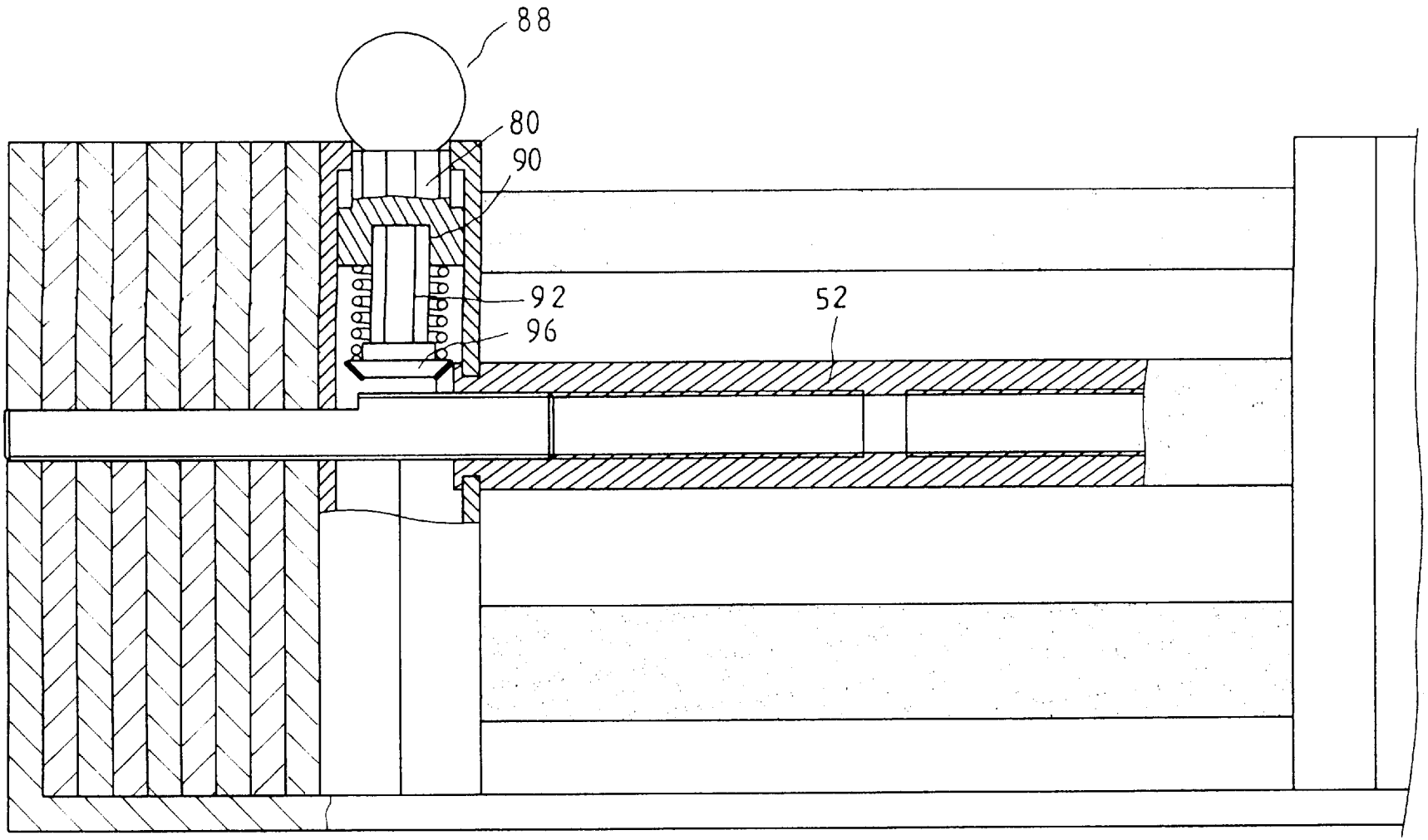
FIG. 4 shows a schematic view of the second preferred embodiment of the present invention.

As illustrated in FIG. 4, the weight of the dumbbell 70 is adjusted by pressing the drive end 88 so as to cause the connection portion 90 of the retaining block 80 to fit over the main body 92. As the drive end 88 is turned again in a predetermined direction, the main body 92 is turned simultaneously in view of the connection portion 90 and the main body 92 being complementary with each other in terms of their cross sections. The grip rod 52 is actuated to turn by the sector gear 96, thereby resulting in a change in the weight of the dumbbell 70.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A dumbbell adjustable in weight, said dumbbell comprising:

a carrying seat having two plates parallel to each other, and a plurality of rods fastened between said two plates;

said two plates being provided at the top of an outer side thereof with two hooked portions;

a plurality of weighted blocks located respectively in equal number at said outer side of each of said two plates;

each of said weighted blocks having a main body which is provided with two connection portions opposite in location to each other;

said connection portions of said weighted blocks being located at various levels on said main body to enable said weighted blocks to be held together side by side such that said hooked portions of said two plates are engaged with said connection portions of said weighted blocks contiguous to said two plates; and a selection device mounted on said carrying seat for enabling a predetermined number of said weighted blocks to be selectively coupled with said carrying seat;

wherein each of said two plates are provided with a first through hole which is provided in an inner edge of an outer end thereof with at least one restraint surface;

wherein said main body of said weighted blocks is provided with a second through hole corresponding in location to said first hole; and wherein said selection device comprises a grip rod rotatably disposed between said first through holes of said two plates and provided at both end thereof with a threaded hole extending along the direction of a longitudinal axis of said grip rod whereby said two threaded holes of said grip rod are opposite in rotation direction to each other, said selection device further comprising two pins which are engaged at one end thereof with said threaded holes of said grip rod and are received at another end thereof in said first through holes of said two plates whereby each of said two pins are provided with at least one press surface pressing respectively against said restraint surface of said first through hole.

2. The dumbbell as defined in claim 1 further comprising a U-shaped placing block which is disposed at bottoms of said weighted blocks and said carrying seat such that two ends of said placing block are in contact with outer sides of said weighted blocks, and that said weighted blocks are retained on said placing block by said connection portions of said weighted blocks.

3. The dumbbell as defined in claim 1, wherein said connection portion of said weighted blocks has a receiving block extending from said main body of said weighted blocks and having a retaining block located at a bottom of said receiving block; and wherein said weighted blocks are held together side by side such that said retaining block of one of said weighted blocks is retained on said receiving block of another weighted block next to said one weighted block.

4. The dumbbell as defined in claim 1, wherein said selection device further comprises an adjustment device which is mounted on one of said two plates and is connected with said grip rod to enable said grip rod to turn in a direction.

5. The dumbbell as defined in claim 4, wherein said adjustment device comprises a drive member movably disposed in said receiving space of said plate, a link member rotatably disposed at the bottom of said control member such that said link member is engaged with one end of said grip rod, and an elastic member disposed between said drive member and said link member for keeping said drive member to remain apart from said link member at such time when said drive member is not exerted on by an external force.

6. The dumbbell as defined in claim 5, wherein said drive member has a retaining block which is complementarily received at a top end thereof in a polygonal opening of said plate, said drive member further having a drive end disposed at said top end of said retaining block and located at a top side of said plate whereby said retaining block is provided at a bottom end thereof with a connection portion corresponding to said link member.

7. The dumbbell as defined in claim 6, wherein said connection portion is a polygonal recess having an opening which faces said link member.

8. The dumbbell as defined in claim 7, wherein said link member has a main body complementary with said connection portion, said link member further having a sector gear which is disposed at a bottom of said main body and engaged with one end of said grip rod; and wherein said elastic member is disposed between said sector gear and said retaining block.

* * * * *